US010093005B2

(12) United States Patent
Zhang et al.

(10) Patent No.: US 10,093,005 B2
(45) Date of Patent: Oct. 9, 2018

(54) BIT ACCESSORY AND BIT ASSEMBLY

(71) Applicant: CHERVON INTELLECTUAL PROPERTY LIMITED, Road Town (VG)

(72) Inventors: Xiaofeng Zhang, Nanjing (CN); Rongzhen Li, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 367 days.

(21) Appl. No.: 14/640,162

(22) Filed: Mar. 6, 2015

(65) Prior Publication Data

US 2016/0016298 A1 Jan. 21, 2016

(30) Foreign Application Priority Data

Jul. 15, 2014 (CN) ..... 2014 2 0392175 U
Dec. 18, 2014 (CN) ..... 2014 1 0797915

(51) Int. Cl.
*B25B 23/00* (2006.01)
*B25B 15/00* (2006.01)
*B25B 23/12* (2006.01)

(52) U.S. Cl.
CPC ..... *B25B 23/0035* (2013.01); *B25B 15/001* (2013.01); *B25B 23/12* (2013.01)

(58) Field of Classification Search
CPC ..... B25B 23/12; B25B 15/001; B25B 21/00; B25B 19/00; B25B 23/0035; B25B 31/107
See application file for complete search history.

(56) References Cited

U.S. PATENT DOCUMENTS 3,712,352 A * 1/1973 Lafferty, Sr. ..... B25B 23/0064 81/429
6,209,426 B1 * 4/2001 Takahashi ..... B25B 23/12 81/451
6,701,812 B1 * 3/2004 Sawamura ..... B25B 23/10 81/452
6,945,142 B1 * 9/2005 Chen ..... B25B 13/06 81/124.3
7,306,396 B1 * 12/2007 Chen ..... B25B 13/5008 279/74

(Continued)

FOREIGN PATENT DOCUMENTS

CN 201711909 U 1/2011
CN 203485090 U 3/2014
JP 2009-39840 A 2/2009

*Primary Examiner* — Robert Scruggs
(74) *Attorney, Agent, or Firm* — Greenberg Traurig, LLP

(57) ABSTRACT

A bit accessory for a bit has a sleeve with an accommodating cavity running through the sleeve and a limiting member with a limiting hole running through the limiting member. The sleeve includes a first stopping portion for stopping the limiting member from passing through the accommodating cavity and the limiting member includes a first hole wall portion forming a first hole wall which provides the limiting hole with a minimum hole diameter and a second hole wall portion forming a second hole wall which provides the limiting hole with a maximum hole diameter. The limiting member is at least partly accommodated in the accommodating cavity, and a direction which the limiting hole runs through the limiting member is parallel to the accommodating cavity when the limiting member is stopped by the first stopping portion.

11 Claims, 9 Drawing Sheets

(56) References Cited

U.S. PATENT DOCUMENTS

| | | | | |
|---|---|---|---|---|
| 8,771,091 | B1 * | 7/2014 | Lin | B25B 15/001 403/383 |
| 2002/0000334 | A1 * | 1/2002 | Lieser | B25B 13/06 175/122 |
| 2007/0084314 | A1 * | 4/2007 | Harker | B25B 13/44 81/125 |
| 2009/0288525 | A1 * | 11/2009 | Chen | B25B 23/12 81/451 |
| 2013/0220086 | A1 * | 8/2013 | Peters | B23B 31/10 81/451 |
| 2015/0298302 | A1 * | 10/2015 | Chen | B25B 23/0014 464/153 |

* cited by examiner

BIT ACCESSORY AND BIT ASSEMBLY

RELATED APPLICATION INFORMATION

This application claims the benefit of CN 201420392175.7, filed on Jul. 15, 2014, and CN 201410797915.X, filed on Dec. 18, 2014, the disclosures of which are incorporated herein by reference in their entirety.

FIELD OF THE DISCLOSURE

The present disclosure relates to a bit accessory, particularly for use with an electric tool.

BACKGROUND OF THE DISCLOSURE

As for the electrical tool with a bit, when the bit is used to tighten a screw, it generally needs two hands to operate, that is to say, one hand supports the screw, and the other hand handles the electric tool, thus this operation is laborious and people cannot do other operations with their hands. Furthermore, current bit accessories are mostly customized based on the structure and standard of a specific bit, and therefore cannot be used with a bit that is commonly available in the market.

SUMMARY

The disclosure describes a bit accessory for a bit, comprising: a sleeve with an accommodating cavity running through the sleeve; and a limiting member with a limiting hole running through the limiting member; wherein the sleeve comprises: a first stopping portion for stopping the limiting member from passing through the accommodating cavity; the limiting hole comprises: a first hole wall portion forming a hole wall of the limiting hole with a minimum hole diameter; and a second hole wall portion forming a hole wall of the limiting hole with a maximum hole diameter; the limiting member is at least partly accommodated in the accommodating cavity, and a direction which the limiting hole runs through the limiting member is parallel to the accommodating cavity when the limiting member is stopped by the first stopping portion.

Furthermore, the bit accessory may comprise a functioning member installed on a front end of the sleeve, wherein the first stopping portion stops the limiting member so that the limiting member is not capable of moving out of the accommodating cavity from the front end of the sleeve on which the functioning member is installed.

Furthermore, the functioning member may have a magnetic portion.

Furthermore, the bit accessory may comprise an installing casing for elastically sleeving on the outer periphery of a bit wherein the installing casing is at least partly accommodated in the accommodating cavity.

Furthermore, the installing casing may be made of rubber material.

Furthermore, the bit accessory may comprise an end cap having an inserting hole with a hole diameter smaller than an outer diameter of the installing casing wherein the end cap is installed on a rear end of the sleeve and the first stopping portion is formed on the front end of the sleeve and stops the installing casing from completely moving out of the sleeve from the front end.

Furthermore, the inserting hole may comprise a limiting wall surface extending along a direction parallel to the accommodating cavity with the limiting wall surface having a minimum hole diameter of the inserting hole.

Furthermore, the first hole wall portion and the second hole wall portion may be arranged alternatively in the circumferential direction of the limiting hole.

Furthermore, the first hole wall portion may protrude from the second hole wall portion.

Furthermore, the first hole wall portion may comprise an inner arc edge and straight edges located on the two sides of the inner arc edge where the two ends of the inner arc edge are connected to one end of each straight edge and the other end of each straight edge is connected to the second hole wall portion.

Furthermore, the second hole wall portion may comprise an outer arc edge having a radius larger than the radius of the arc of the inner arc edge with the two ends of the outer arc edge being connected to different straight edges.

The disclosure also describes a bit assembly, comprising: a bit with a head; and a bit accessory; wherein the bit accessory comprises: a sleeve with an accommodating cavity running through the sleeve; and a limiting member with a limiting hole running through the limiting member; the sleeve comprises: a first stopping portion for stopping the limiting member from passing through the accommodating cavity; the limiting hole comprises: a first hole wall portion forming a hole wall of the limiting hole with a minimum hole diameter; and a second hole wall portion forming a hole wall of the limiting hole with a maximum hole diameter; the limiting member is at least partly accommodated in the accommodating cavity, and a direction which the limiting hole running through the limiting member is parallel to the accommodating cavity when the limiting member is stopped by the first stopping portion.

The disclosure also describes a bit accessory for a bit, comprising: a sleeve having an accommodating cavity for a bit to pass through; and an installing casing accommodated in the accommodating cavity and being capable of moving along an extending direction of the accommodating cavity in a determined range; wherein the installing casing is capable of elastically covering the outer periphery of the bit passing through the installing casing.

Furthermore, the sleeve may comprise a first stopping portion for stopping the installing casing from further moving towards a front end of the sleeve.

Furthermore, the sleeve may comprise a second stopping portion for stopping the installing casing from further moving towards a rear end of the sleeve.

Furthermore, the sleeve may comprise a limiting portion formed in the accommodating cavity and the bit accessory may further comprise a functioning member arranged on the front end of the sleeve with the limiting portion being arranged between the functioning member and the installing casing.

Furthermore, the sleeve may comprise a sleeve body and an end cap with the accommodating cavity being formed in the sleeve body, the end cap comprising a cover portion for partly covering the rear end of the accommodating cavity, the cover portion having an inserting hole, and the end cap being arranged on a rear end of the sleeve body, the first stopping portion may comprise a first annular surface formed by the sleeve body in the accommodating cavity, and the second stopping portion may comprise a second annular surface formed by an inner side of the cover portion.

Furthermore, the end cap may be fixed on the rear end of the sleeve body by a thread connection with the sleeve body forming an outer threaded portion and the end cap forming an inner threaded portion.

Furthermore, the installing casing may be made of rubber material.

Furthermore, the functioning member may be a ring having magnetism with the front end of the sleeve being provided with an opened installing groove in which the functioning member is fixed.

As will be understood more particularly from the description that follows, with the cooperation of the limiting member and the bit, the technical solution of the described assemblies can obtain positive effects in that, via use of the bit accessory, the screw can be supported by one hand, and the bit accessory can be used for various bits with different standards.

DETAILED DESCRIPTION

The present disclosure will be explained in detail with reference to the accompanying drawings and specific embodiments.

Figure 1:
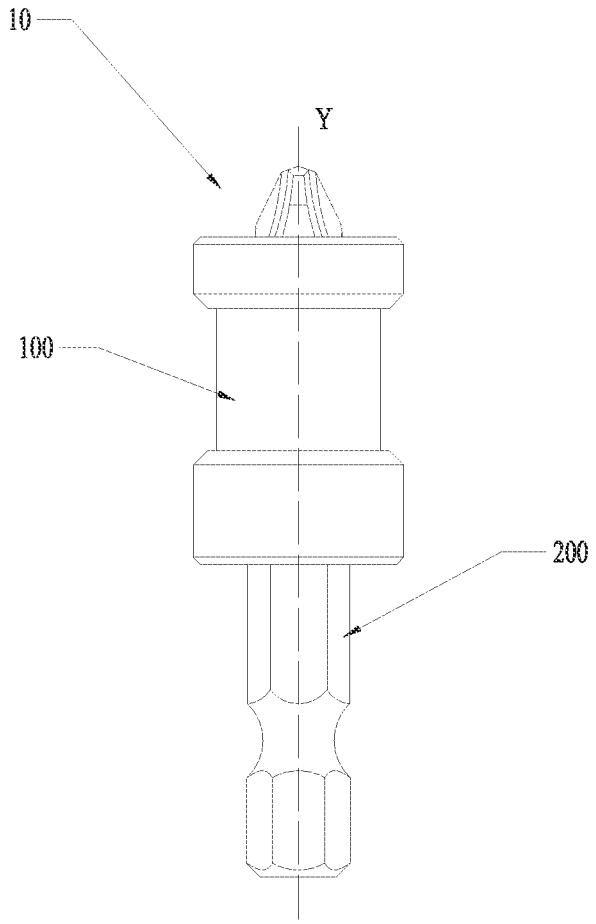
FIG. 1 is a structure schematic view of an exemplary bit accessory according to the present disclosure sleeved on a bit.
Figure 2:
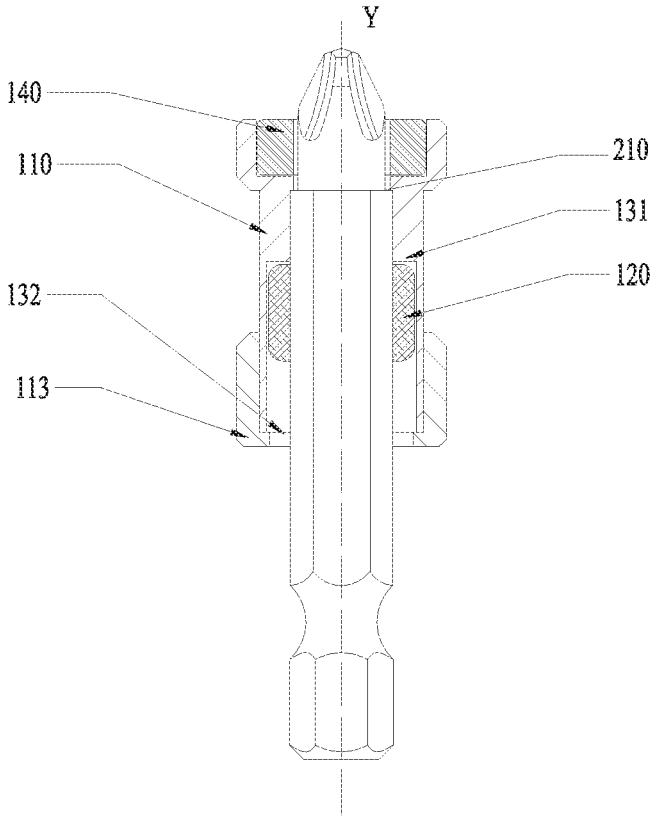
FIG. 2 is a sectional schematic view of the bit accessory of FIG. 1.
Figure 3:
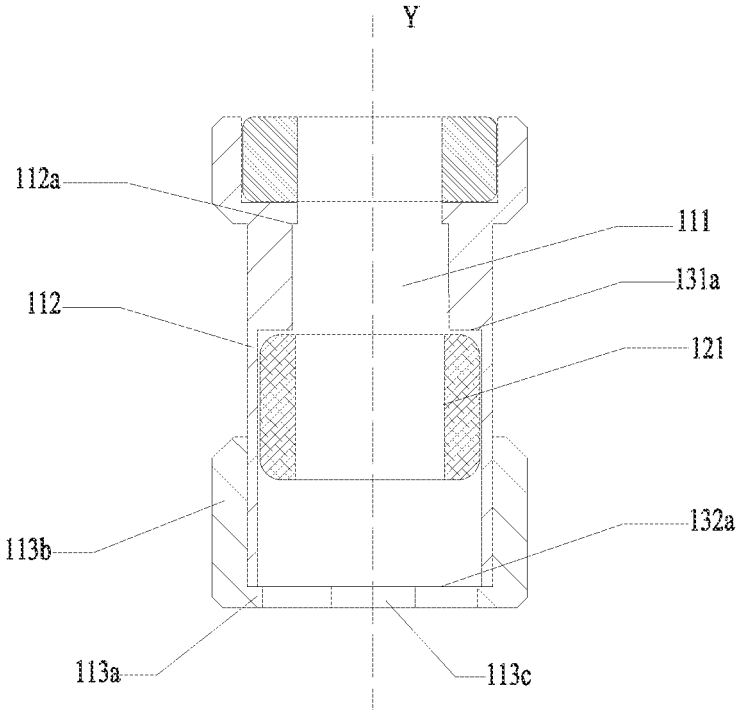
FIG. 3 is a sectional schematic view of the bit accessory of FIG. 1.

The present disclosure describes a bit assembly 10 having a bit accessory and a bit. The bit may be the bit of FIG. 1, the bit with a connecting rod or the bit of FIG. 7. FIGS. 1-3 show a bit 200 and a bit accessory 100 used with the bit 200. The bit accessory 100 comprises a sleeve 110, an installing casing 120, a stopping portion, and a functioning member 140. The installing casing 120 is a revolution body which can rotate around its central axis. In order to simply introduce the technical solution of the present disclosure, definition is made as follows: the central axis around which the installing casing revolves is defined as a first axis Y, the direction of the first axis Y and the direction parallel to the first axis Y is defined as the axial direction, the circumferential direction around the first axis Y is defined as the circumferential direction, in the axial direction, one end towards the functioning member 140 is defined as the front, and the other end is defined as the rear. The above definitions do not limit the scope of the present disclosure in any form.

As shown in FIGS. 2 and 3, the sleeve 110 serves as the main supporting portion in the bit accessory 100, and an accommodating cavity 111 for the bit 200 to pass through is arranged in the interior thereof. The accommodating cavity 111 runs through the whole sleeve 110. The sleeve 110 comprises a sleeve body 112 and an end cap 113. The sleeve body 112 comprises an outer wall and an inner wall forming the accommodating cavity 111. The accommodating cavity 111 extends in the axial direction. The end cap 113 is arranged on a rear end of the sleeve body 112, and comprises a cover portion 113*a* and a connecting portion 113*b*. The middle of the cover portion 113*a* is provided with an inserting hole 113*c* for the bit 200 to pass through. The cover portion 113*a* is provided with the inserting hole 113*c* so that the cover portion 113*a* can partly cover the rear end of the accommodating cavity 111. The hole diameter of the inserting hole 113*c* is smaller than the outer diameter of the installing casing 120. The connecting portion 113*b* is sleeved on the outer wall of the sleeve body 112. The connecting portion 113*b* is an inner threaded portion with inner threads therein and the end portion of the sleeve body 112 is an outer threaded portion with outer threads on the outer wall thereof. With the cooperation of the inner threads and the outer threads, the end cap 113 can be removably fixed on the sleeve body 112. As such, the installing casing 120 in the sleeve 110 may be replaced according to requirements. It should be appreciated that the end cap 113 may also be fixed on the sleeve body 112 by interference fit.

The sleeve 110 may be made of a transparent material, and a fluorescent material may also be added into the transparent material. As such, when the bit accessory 100 is used in a relatively dark area, it can illuminate the working area.

The sleeve body 112 is further provided with a limiting portion 112*a* therein, and the limiting portion 112*a* is arranged between the functioning member 140 and the installing casing 130. When the bit accessory 100 is sleeved on the bit 200, the limiting portion 112*a* can stop the bit 200 from further moving forwards relative to the sleeve body 112. The forming of the limiting portion 112*a* enables the bit accessory 100 of the present disclosure to be used with the bit 200 of FIG. 1, and the limiting portion 112*a* cooperates with a shoulder portion of the bit 200 so that the length of the bit 200 passing through the sleeve 110 is limited.

The installing casing 120 is received in the accommodating cavity 111, and can move in a determined range in the accommodating cavity 111 along the extending direction of the accommodating cavity 111, that is to say, the installing casing 120 can move forward and backward in the axial direction. The installing casing 120 comprises a sleeving portion 121 arranged in the inner circle by which the installing casing 120 can elastically cover the outer periphery of the bit 200. In the illustrated example, the section of the installing casing 120 in the circumferential direction has an annular structure, and the axial length of the installing casing 120 is between 0 mm and 20 mm. More preferably, the axial length of the installing casing 120 is between 5 mm and 20 mm. The installing casing 120 with a certain length can enable the bit 200 and the sleeve 110 to be parallel to each other. Additionally, in order to enable the sleeving portion 121 to elastically cover the bit 200, the installing casing 120 is made of an elastic material, such as rubber material, thus the installing casing 120 can be tightly sleeved on the bit 200.

The sleeve 110 further comprises a stopping portion for stopping the installing casing 120 from moving forward and backward to the extreme position along the axial direction in the accommodating cavity 111. Specifically, the stopping portion comprises a first stopping portion 131 and a second stopping portion 132. The first stopping portion 131 is used to stop the installing casing 120 from further moving forward in the axial direction relative to the accommodating cavity 111, thereby stopping the installing casing 120 from completely moving out of the sleeve 110 from a front end. The first stopping portion 131 is arranged in the interior of the sleeve body 112 and at the front end in the axial direction of the accommodating cavity 111. The first stopping portion 131 comprises a first annular surface 131*a* which is a surface of the sleeve body 112 extending inwards in the accommodating cavity 111. The second stopping portion 132 is used to stop the installing casing 120 from further moving backward in the axial direction relative to the accommodating cavity 111. The second stopping portion 132 is arranged at the rear end of the sleeve body 112. The second stopping portion 132 comprises a second annular surface 132*a* which is formed by the inner side of the cover portion 113*a*. The second stopping portion 132 is a part of the cover portion 113*a*.

The functioning member 140 is arranged at the front end of the sleeve 110. The bit accessory 100 may have various functions depending on different functioning members 140. In order to tighten the screw by one hand without supporting the screw by hand, the functioning member 140 is a ring having magnetism. Further, in order to attract the screw, the ring is a magnet installed in an opened installing groove (not shown) arranged at the front end of the sleeve 110. The magnet is a hollow cylinder so that the interior of the magnet may be communicated with the accommodating cavity 111. As such, when the bit accessory 100 is sleeved on the bit 200 and the bit 200 moves close to the screw, the screw may be attracted by the magnet of the bit accessory 100, thus it can achieve one-hand operation without the need for supporting the screw by hand. Additionally, the functioning member 140 may also be other devices depending on the function of the bit accessory 100. For example, the functioning member 140 is a light source, thus when the bit accessory 100 is sleeved on the bit 200, it can illuminate during the operation in some dark areas. The sleeve 100 may also be made of aluminum or plastics, so as to prevent from affecting the magnetism of the magnet and therefore affecting the effect of attracting the screw.

The bit accessory 100 is sleeved on the bit 200. When the screw needs to be tightened, the bit 200 is moved close to the screw, and then the screw is steadily fixed on the bit 200 by the magnet of the bit accessory 100, thus the bit accessory 100 may be operated by one hand without handling the screw by hand. Additionally, the installing casing 120 of the present disclosure can move forward and backward along the axial direction in the accommodating cavity 111. As such, when the bit accessory 100 is sleeved on the bit 200, if the sleeved position is not accurate so that the magnet is far from the screw and cannot attract the screw completely, since the installing casing 120 can move forward and backward relative to the sleeve body 112 and the installing casing 120 is sleeved on the bit 200, the sleeve body 112 and the magnet can automatically move towards the screw relative to the bit 200 under the action of the magnetic force, thus the screw may be attracted more steadily, without additionally adjusting the position of the bit accessory 100 on the bit 200, thereby achieving one-hand operation for tightening the screw.

The bit accessory 100 and the bit 200 constitute a bit assembly 10. The bit 200 partly passes through the accommodating cavity 111, and the installing casing 120 covers the bit 200. The sleeve 110 of the bit accessory 100 is provided with a limiting portion 112*a*, and the bit 200 further has a stepped structure 210 for cooperating with the limiting portion 112*a*. The stepped structure 210 may be the shoulder portion of the bit 200. With the cooperation of the limiting portion 112*a* and the stepped structure 210, the bit 200 is stopped from passing through the bit accessory 100 and further moving forwards relative to the bit accessory 100.

Figure 4:
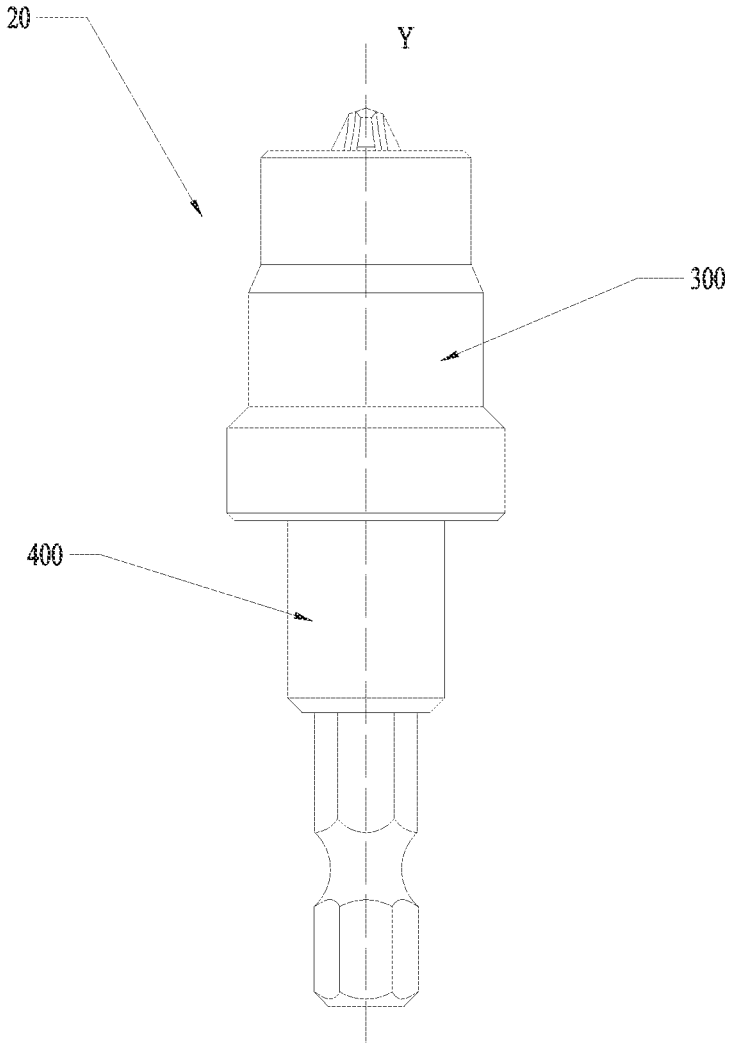
FIG. 4 is a structure schematic view of a bit accessory according to the present disclosure sleeved on another bit having a connecting rod.
Figure 5:
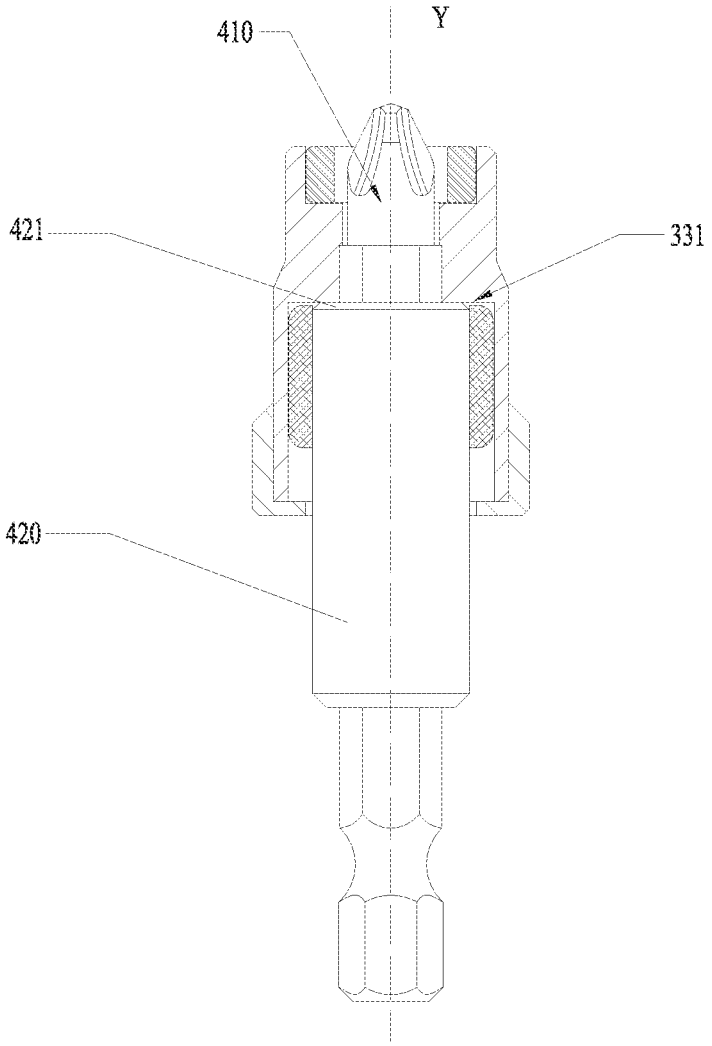
FIG. 5 is a sectional schematic view of the bit accessory of FIG. 4.
Figure 6:
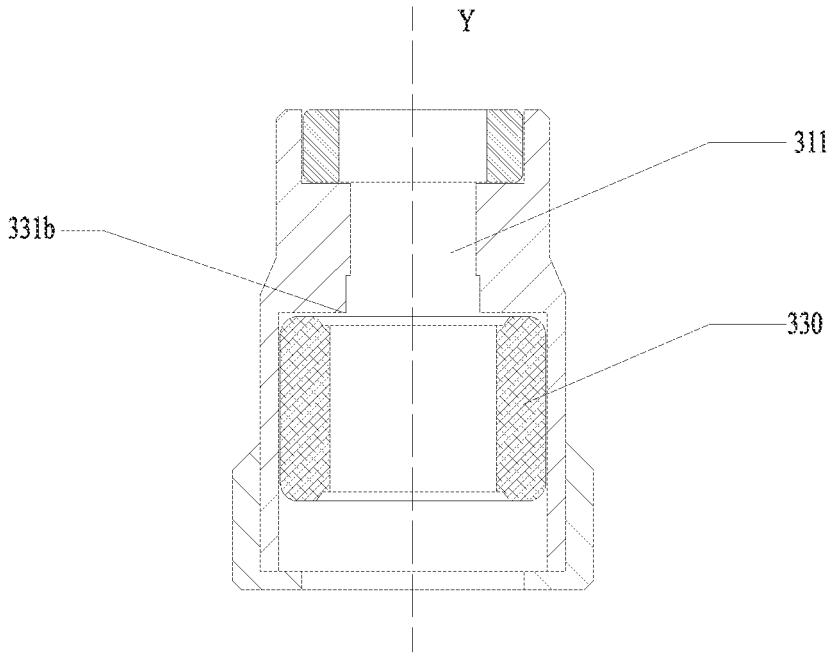
FIG. 6 is a sectional schematic view of the bit accessory of FIG. 4.

As shown in FIGS. 4-6, for another bit 400 having a connecting rod 420 in another bit assembly 20, there is another bit accessory 300 used for the bit 400. An installing casing 330 in the bit accessory 300 is sleeved on the connecting rod 420. A second limiting portion 331*b* is formed by the extension of a first stopping portion 331 extending inwards in the interior of an accommodating cavity 311. The second limiting portion 331*b* cooperates with a second stepped structure 421 arranged on the connecting rod 420 in order to further stop the bit 400 from passing through the interior of the bit accessory 300 and moving forwards relative to the bit accessory 300. The bit accessory 300 is not only used for the bit 400 having the connecting rod, but also used for the bit 200 of FIG. 1. The other structures of the bit accessory 300 are the same as those of the bit accessory 100.

Figure 7:
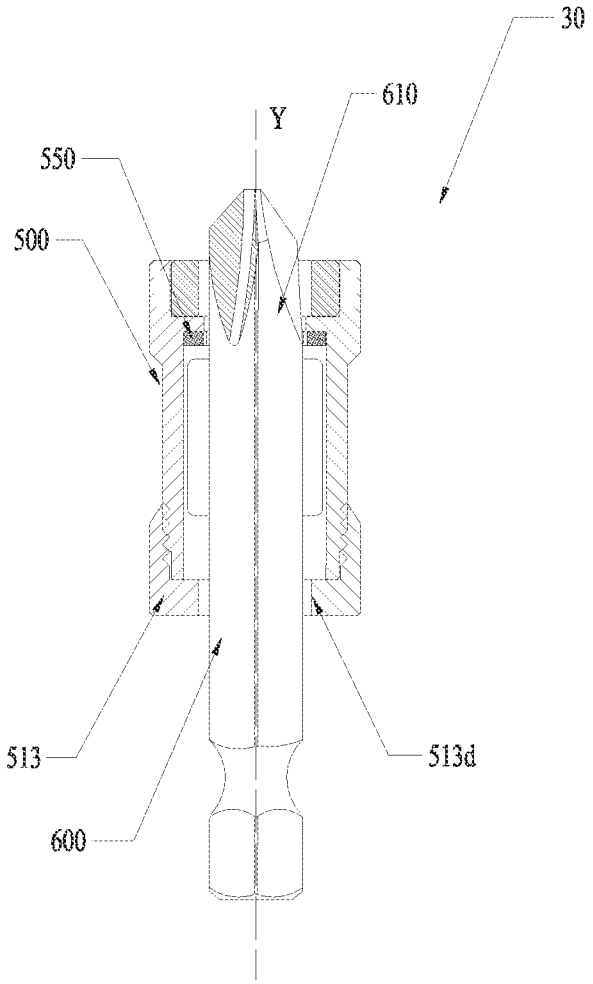
FIG. 7 is a sectional schematic view of a bit accessory according to the present disclosure sleeved on another bit.
Figure 8:
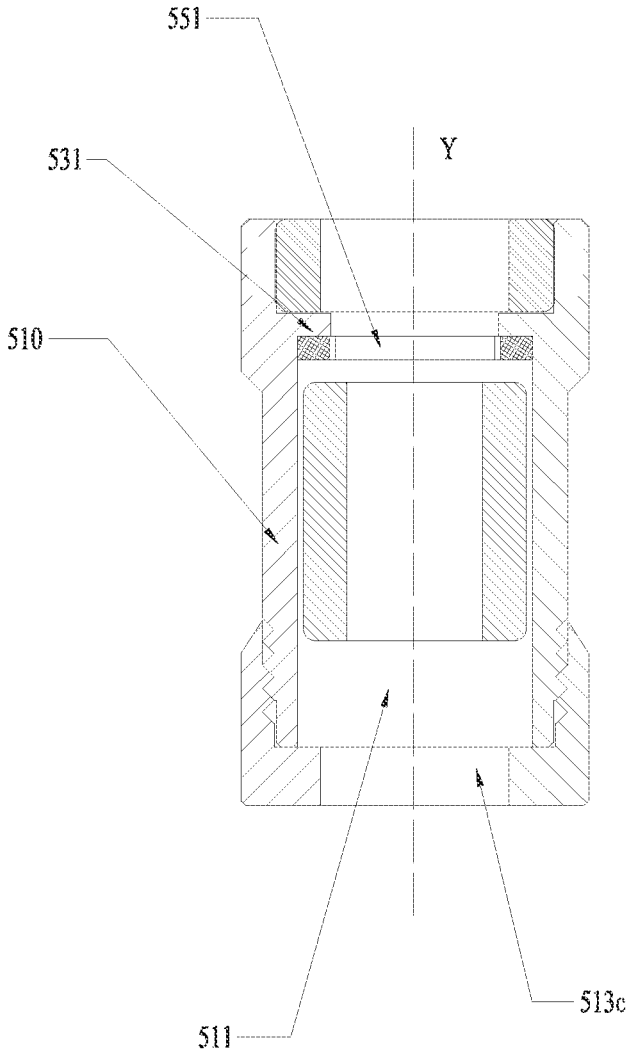
FIG. 8 is a sectional schematic view of the bit accessory of FIG. 7.

As shown in FIGS. 7-10, in order to broaden the application of the present disclosure, for another bit 600 of FIG. 7 in another bit assembly 30, there is another bit accessory 500 used for the bit 600. The bit accessory 500 has a structure that is generally the same as that of the bit accessory 100, and the difference lies in that it further comprises a limiting member 550. The limiting member 550 limits the length of the bit 600 passing through and protruding from the bit accessory 500. The limiting member 550 is provided with a limiting hole 551 running through the limiting member 550. The limiting hole 551 further comprises a first hole wall portion 552 and a second hole wall portion 553. The first hole wall portion 552 is used to form a hole wall of the limiting hole 551 with a minimum hole diameter and the second hole wall portion 553 is used to form a hole wall of the limiting hole 551 with a maximum hole diameter. The limiting member 550 is arranged in an accommodating cavity 511 of a sleeve 510, and installed in the accommodating cavity 511 from the rear end of the accommodating cavity 511, while a first stopping portion 531 in the accommodating cavity 511 can prevent the limiting member 550 from further moving out of the accommodating cavity 511 from the front end, thus the limiting member 550 is installed in the accommodating cavity 511. When the limiting member 550 is in the installing position stopped by the first stopping portion 531, the direction which the limiting hole 551 runs through the limiting member 550 is also parallel to the accommodating cavity 511, that is to say, the direction which the limiting hole 551 runs through the limiting member 550 is also parallel to the extending direction of the accommodating cavity 511. Specifically, the direction which the limiting hole 551 runs through the limiting member 550 is also parallel to the first axis Y. It should be noted that in the present disclosure, the description of the structure of the limiting member 550 is based on the reference state in which the limiting member 550 is in the installing position, but this description does not limit the scope of the present disclosure in any form. Additionally, as for the direction which the limiting hole 551 runs through the limiting member 550 and the extending direction of the accommodating cavity 511, it should be noted that if the area surrounded by the limiting hole 551 or the accommodating cavity 511 is considered as a fictitious entity, the central axial direction of the entity refers to the direction which the limiting hole 551 runs through the limiting member 550 or the extending direction of the accommodating cavity 511.

Specifically, the thickness of the limiting member 550 in the axial direction is between 0.1 and 5 mm, and is relatively thin. The first hole wall portion 552 and the second hole wall portion 553 are arranged at the same axial position in the limiting hole 551, that is to say, if the thickness of the first hole wall portion 552 and the second hole wall portion 553 in the axial direction is ignored, the first hole wall portion 552 and the second hole wall portion 553 are in the same plane perpendicular to the first axis Y, thus the first hole wall portion 552 and the second hole wall portion 553 of the limiting hole 551 may be regarded as an inner circle of the section of the limiting member 550 perpendicular to the first axis Y. Further, an outer circle of the section is round. At the inner circle, the first hole wall portion 552 and the second hole wall portion 553 are arranged alternatively in the circumferential direction of the limiting hole 551, and the first hole wall portion 552 protrudes from the second hole wall portion 553. The first hole wall portion 552 comprises an inner arc edge 552*a* and straight edges 552*b*. The inner arc edge 552*a* is an arc having a first radius, and two straight edges 552*b* are respectively arranged on the two sides of the inner arc edge 552*a*. The two ends of the inner arc edge 552*a* are respectively connected to one end of each straight edge 552*b* on the two sides, and the other end of each straight edge is connected to the second hole wall portion 553. The second hole wall portion 553 comprises an outer arc edge 553*a* with two ends connected to the straight edges 552*b*. The outer arc edge 553*a* is an arc having a second radius larger than the first radius, thus the distance between the inner arc edge 552*a* and the first axis Y is smaller than the distance between the outer arc edge 553*a* and the first axis Y, and therefore the first hole wall portion 552 protrudes from the second hole wall portion 553.

Preferably, the limiting member 550 is made of steel, thus the limiting member 550 has high hardness and good wear resistance.

Figure 9:
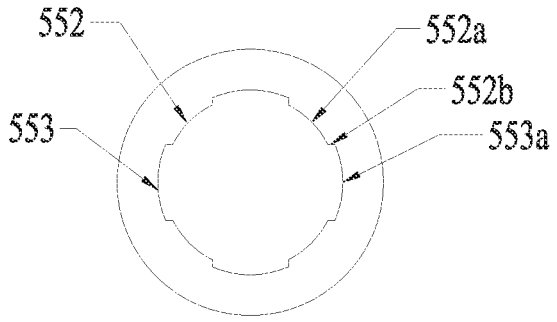
FIG. 9 is a structure schematic view of a limiting member of FIG. 8.
Figure 10:
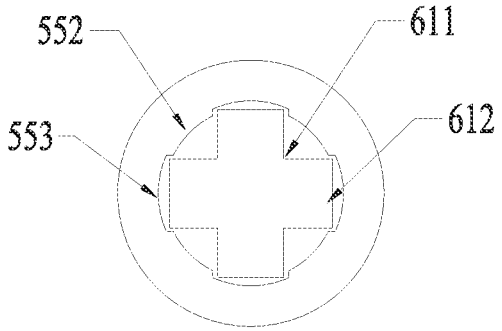
FIG. 10 is a sectional view of the limiting member used for the bit in FIG. 8.

As shown in FIGS. 7, 9 and 10, firstly, the bit 600 is inserted into the accommodating cavity 511 via the inserting hole 513*c* of the end cap 513 and passes through the installing casing 520, the limiting member 550 and the functioning member 540, until it partly protrudes from the sleeve 510. In order to limit the length of a head 610 of the bit 600 protruding from the sleeve 510, the limiting member 550 cooperates with the head 610 of the bit 600 for limiting position. Specifically, the first hole wall portion 552 and the second hole wall portion 553 of the limiting hole 551 of the limiting member 550 cooperate with a groove 611 and a projection 612 of the head 610, wherein the first hole wall portion 552 is located in the groove 611 of the head 610 in a plane perpendicular to the first axis Y and the projection 612 of the head 610 is located in the second hole wall portion 553 of the limiting member 550, and they are locked with each other, thus the bit 600 can only partly pass through the limiting hole 551 and contact the first hole wall portion 552, thereby limiting the length of the bit 600 protruding from the sleeve 510 so as to prevent it protruding from the sleeve 510 too long, thus the sleeve 510 can attract the screw firmly and achieve one-handed operation.

In order to lock the bit 600 with the limiting hole 551 of the limiting member 550, the sizes of the first hole wall portion 552 and the second hole wall portion 553 of the limiting member 550 may be preset. For example, for the bit 600 having a Phillips-head, the radius of the first hole wall portion 552 should be smaller than the distance between the projection 612 and the center of the Phillips-head and larger than the distance between the groove 611 and the center of the Phillips-head, while the radius of the second hole wall portion 553 should be larger than the distance between the projection 612 and the center of the Phillips-head. Moreover, the chord length of the first hole wall portion 552 should be larger than the distance between two ends of the adjacent two projections 612 away from the head 610.

For other bits 600, the first hole wall portion 552 and the second hole wall portion 553 of the limiting member 550 may also be preset, thus it is unnecessary to go into details here.

The bit accessory 500 is not only used for the bit 600 of FIG. 7, but also used for the bit 200 of FIG. 1 as well as the bit 400 having a connecting rod 420. The bit accessory 500 is not only used for a separate bit 200, but also used for the bit integrated with a screw driver. As for the bit 200 of FIG. 1, the limiting member 550 may be locked with the shoulder portion of the bit 200 for limiting position. Then, the bit accessory 500 is not provided with the limiting portion 112*a* of the bit accessory 100. Further, as for the bit 400 having a connecting rod 420, the limiting member 550 may also be locked with the connection portion between the head 410 of the bit 400 and the connecting rod 420 for limiting position. That is to say, the bit accessory 500 of the present disclosure can be used with at least 95% of the common bits in the market. The common bits herein refer to the general standard bit in the market. For example, the portion adjacent to the head of the bits is not machined to be thinner or other irregular shapes.

In order to further ensure the concentricity of the bit 600 relative to the bit accessory 500 when the bit accessory 500 is sleeved on the bit 600, the end cap 513 has a limiting wall surface 513*d* extending along a direction parallel to the extending direction of the accommodating cavity 511 in the inserting hole 513*c*, and the limiting wall surface 513*d* forms the portion of the inserting hole 513*c* having a minimum hole diameter. Actually, the thickness of the end cap 513 substantially determines the length of the limiting wall surface 513*d* along the extending direction of the accommodating cavity 511. Thus, in order to enable the length of the limiting wall surface 513*d* to be as large as possible, the thickness of the end cap 513 has to be relatively large, thus the contact area of the limiting wall surface 513*d* and the side of the bit 600 is relatively large, thereby preventing the bit 600 from deflecting from the first axis Y relative to the sleeve 510 due to the outer force and magnetic force of the magnet and ensuring the concentricity. Specifically, the ratio of the hole diameter of the inserting hole 513*c* to the length of the limiting wall surface 513*d* along the extending direction of the accommodating cavity 511 is referred to as a reference value, preferably larger than or equal to 1.1 and smaller than or equal to 5.5. Further, the length of the limiting wall surface 513*d* along the extending direction of the accommodating cavity 511 is preferably larger than or equal to 2 mm and smaller than or equal to 5 mm.

The limiting member 550 in the above bit accessory 500 may also be formed separately from the sleeve 510. But, in another embodiment, the limiting member may also be integrally formed together with the sleeve. That is to say, the sleeve is formed with a through hole therein, and the through hole extends along the direction of the first axis. The sleeve further comprises a first hole wall portion and a second hole wall portion at the same axial position. The first hole wall portion forms the wall portion having a minimum hole diameter, and the second hole wall portion forms the wall portion having a maximum hole diameter, and in the radial direction of the through hole, the first hole wall portion protrudes from the second hole wall portion. That is to say, in the present embodiment, the limiting member is not formed separately, and it is directly formed by the inner wall of the sleeve. As for other portions of the sleeve, such as the stopping portion, the installing casing, the functioning member and the end cap may also have the above structure. The bit accessory may also constitute the bit assembly with the bit.

The above illustrates and describes basic principles, main features and advantages of the present disclosure. Those skilled in the art should appreciate that the above embodiments do not limit the present disclosure in any form. Rather, technical solutions obtained in a way of equivalent substitution or equivalent variations are all intended to fall within the scope of the claims set forth hereinafter.

What is claimed is:

1. A bit accessory for a bit having a head, comprising:

a sleeve with an accommodating cavity running through the sleeve;

a limiting member removably attached to the sleeve, the limiting member defining a limiting hole shaped to mate with at least a part of the head so as to limit the length of the bit passing through the sleeve;

an installing casing for elastically sleeving over an outer periphery of the bit, wherein the installing casing is a least partly accommodated in the accommodating cavity; and an end cap having an inserting hole with a hole diameter smaller than an outer diameter of the installing casing wherein the end cap is installed on a rear end of the sleeve, wherein the sleeve comprises a first stopping portion for stopping the limiting member from passing through the accommodating cavity;

wherein an inner wall of the limiting hole comprises a first hole wall portion forming a first hole wall of the limiting hole and providing the limiting hole with a minimum hole diameter and a second hole wall portion forming a second hole wall of the limiting hole and providing the limiting hole with a maximum hole diameter;

wherein the limiting member is at least partly accommodated in the accommodating cavity and a direction which the limiting hole runs through the limiting member is parallel to the accommodating cavity when the limiting member is stopped by the first stopping portion, wherein the thickness of the limiting member in the direction which the limiting hole runs through the limiting member is between 0.1 and 5 mm and the first hole wall portion and the second hole wall portion are arranged at the same position along the direction in which the limiting hole runs through the limiting member;

wherein the first hole wall portion and the second hole wall portion are arranged alternatively along the circumferential of the direction which the limiting hole runs through the limiting member and the first hole wall portion protrudes from the second hole wall portion, and wherein the end cap comprises a cover portion for covering a part of the accommodating cavity at the rear end of the sleeve and stopping the limiting member from moving out of the accommodating cavity from the rear end of the sleeve and a connecting portion threadably connected to the sleeve, and the installing casing and the limiting member can move out of the accommodating cavity from the rear end of the sleeve when the end cap is removed from the sleeve.

2. The bit accessory according to claim 1, further comprising a functioning member installed on a front end of the sleeve wherein the first stopping portion stops the limiting member so that the limiting member is incapable of moving out of the accommodating cavity from the front end of the sleeve on which the functioning member is installed.

3. The bit accessory according to claim 2, wherein the functioning member has a magnetic portion.

4. The bit accessory according to claim 1, wherein the installing casing is made of rubber material.

5. The bit accessory according to claim 1, wherein the first stopping portion is formed on the front end of the sleeve and stops the installing casing from completely moving out of the sleeve from the front end.

6. The bit accessory according to claim 5, wherein the end cap comprises a limiting wall surface extending along a direction parallel to the accommodating cavity and the limiting wall surface provides a minimum hole diameter of the inserting hole.

7. The bit accessory according to claim 1, wherein the first hole wall portion and the second hole wall portion are arranged alternatively in the circumferential direction of the limiting hole.

8. The bit accessory according to claim 1, wherein the first hole wall portion protrudes from the second hole wall portion.

9. The bit accessory according to claim 8, wherein the first hole wall portion comprises an inner arc edge and straight edges located on the two sides of the inner arc edge, and the two ends of the inner arc edge are connected to one end of each straight edge and the other end of each straight edge is connected to the second hole wall portion.

10. The bit accessory according to claim 9, wherein the second hole wall portion comprises an outer arc edge having a radius larger than the radius of the arc of the inner arc edge and the two ends of the outer arc edge are connected to different straight edges.

11. A bit assembly, comprising:

a bit with a head; and a bit accessory;

wherein the bit accessory comprises:

a sleeve with an accommodating cavity running through the sleeve;

a limiting member removably attached to the sleeve, the limiting member defining a limiting hole shaped to mate with at least a part of the head so as to limit the length of the bit passing through the sleeve;

an installing casing for elastically sleeving over an outer periphery of the bit wherein the installing casing is at least partly accommodated in the accommodating cavity; and an end cap having an inserting hole with a hole diameter smaller than an outer diameter of the installing casing wherein the end cap is installed on a rear end of the sleeve, wherein the sleeve comprises:

a first stopping portion for stopping the limiting member from passing through the accommodating cavity;

wherein an inner wall of the limiting hole comprises:

a first hole wall portion forming a first hole wall of the limiting hole and providing the limiting hole with a minimum hole diameter and a second hole wall portion forming a second hole wall of the limiting hole and providing the limiting hole with a maximum hole diameter;

wherein the limiting member is at least partly accommodated in the accommodating cavity and a direction which the limiting hole runs through the limiting member is parallel to the accommodating cavity when the limiting member is stopped by the first stopping portion, wherein the thickness of the limiting member in the direction which the limiting hole runs through the limiting member is between 0.1 and 5 mm and the first hole wall portion and the second hole wall portion are arranged at the same position along the same direction which the limiting hole runs through the limiting member;

wherein the first hole wall portion and the second hole wall portion are arranged alternatively along the circumferential of the direction which the limiting hole runs through the limiting member and the first hole wall portion protrudes from the second hole wall portion, and wherein the end cap includes a cover portion for covering a part of the accommodating cavity at the rear end of the sleeve and stopping the limiting member from moving out of the accommodating cavity from the rear end of the sleeve and a connecting portion threadably connected to the sleeve, and the installing casing and the limiting member can move out of the accommodating cavity from the rear end of the sleeve when the end cap is removed from the sleeve.

* * * * *